United States Patent [19]

Ireton

[11] Patent Number: 4,732,082

[45] Date of Patent: Mar. 22, 1988

[54] APPARATUS AND METHOD FOR MOUNTING EMBOSSING ROLLERS IN A PRESS LINE

[76] Inventor: Carl Ireton, 3189 Sunny Crest La., Kettering, Ohio 45419

[21] Appl. No.: 878,433

[22] Filed: Jun. 25, 1986

[51] Int. Cl.[4] ..... B31F 1/07

[52] U.S. Cl. ..... 101/23; 101/32

[58] Field of Search ..... 101/32, 3 R, 5, 6, 7, 101/22–24; 100/158 R, 176; 118/DIG. 15; 29/148.4 D, 469

[56] References Cited

U.S. PATENT DOCUMENTS

| | | | |
|---|---|---|---|
| 3,264,978 | 8/1966 | Staley | 101/23 |
| 3,309,984 | 3/1967 | MacKay | 101/32 |
| 3,418,925 | 12/1968 | Wiggins | 101/23 |
| 3,470,816 | 10/1969 | Piecha et al. | 101/216 |
| 3,876,087 | 4/1975 | Osta | 101/216 |
| 3,990,391 | 11/1976 | Singh | 100/176 |
| 4,389,114 | 6/1983 | Westerman | 118/DIG. 15 |

*Primary Examiner*—Edgar S. Burr
*Assistant Examiner*—Huong Q. Pham
*Attorney, Agent, or Firm*—Allan Redrow; Solon B. Kemon

[57] ABSTRACT

A preassembled set of embossing rolls is shown. The embossing roll assembly is completed and tested at a work station away from a press line and thereafter the assembled set of rolls is transported to the press line for installation whereby down time on the press is avoided while the precision assembly of the matched pair of rollers is accomplished elsewhere.

2 Claims, 3 Drawing Figures

APPARATUS AND METHOD FOR MOUNTING EMBOSSING ROLLERS IN A PRESS LINE

FIELD OF INVENTION

This invention relates to an embossing roll assembly for use in a line with a printing press or the like.

PRIOR ART

A patent showing a typical embossing structure which is the best art known to the inventor at the time of the filing of this application is U.S. Pat. No. 3,309,984 to MacKay, Mar. 21, 1967, wherein embossing rollers 10 and 25 are driven in synchronysm by meshing gears 20 and 43. The rollers are carried on stub shafts 12 and 13 and 28 and 29 that rotate in bearings 17 and 18 mounted in the press frame 19. Stub shaft 12 carries gear 21 that meshes with drive gear 51. As stated in column 3, lines 7 and 8, the gears 20 and 43 are suitably marked so that the matched pair of embossing rolls can be rotated in synchronysm and drive gear 51 must be timed to drive the embossing rolls to match the speed of the printed web flowing to the rolls (see column 4, lines 32+).

When the embossing rolls must be changed, it is apparent that the press line must be stopped to fit the stub shafts into bearings 17 and 18, then the new rollers must be accurately matched when gears 20 and 43 are filled to stub shafts 13 and 29. It is not shown how the longitudinal alignment of these embossing rolls is accomplished relative to the line of printed material, but obviously suitable spacer means must be fitted between the frame 19 of the press and the rollers to position them properly. Thereafter the drive gear 51 can be meshed with gear 21 to connect up the drive.

BACKGROUND OF THE INVENTION

Frequently embossing rolls are associated with printing presses and are used to emboss successive areas of a paper strip or other films, including plastic or aluminum foil for producing three dimentional effects on a finished printed roll of labels or the like. The patented art cited above shows a typical embossing roll station adapted to cooperate with a printing press. When a line of printed material is to be embossed, the bearing mountings for the embossing rolls are built into the press line and the rollers are driven to rotate in precise sequence to the operation of the printing means so that the desired embossing of the areas that are to be made three dimensional, can be coordinated with a printed label run for example. The resulting line of printed and embossed labels can then be rolled up for delivery to the ultimate user.

From time to time the pair of embossing rolls on a press line must be replaced, and particularly in a job shop printing activity, where different customers make use of embossed label designs, the embossing rolls at the embossing station must be changed with each press run. When a changeover is being made, in following current practice, it is necessary to tie up the entire press line, and because of the extreme care that is required to effect the necessary precision required in mounting the new pair of embossing rollers in order to coordinate the embossed design with the printed matter, the down time consumed in making a change over and the time spent by skilled press operators in such labors, makes the replacement of embossing rolls a relatively costly procedure.

Embossing rolls have matching three dimensional contoured peripheries, one of the peripheries being a male protrusion and the other a corresponding matching female depression. The rolls are usually formed integrally with bearing shafts that are intergeared so that the peripheral surfaces of the rollers rotate into opposed positions precisely matching one another to emboss the material being passed between the rolls. Not only must the embossing station be positioned precisely relative to the printing press but the embossing rollers themselves must be positioned at their station to coact properly one with the other to produce the desired embossed design in the exact position required on the printed line of labels or the like issuing from the printing press. Depending upon their design, certain of such rollers can be quite heavy, thus necessitating extreme care in handling to avoid any damage to their embossing die surfaces while being fitted into the press line. Thus at the properly located embossing station of conventional printing presses, the embossing rolls, some of which may be difficult to manipulate into place, must be carefully aligned both longitudinally and latterally to rotate precisely relatively to each other and the matched rollers must also be adjusted to coact with the line of printed matter, which of course, necessitates that they must also be rotated to a precise position.

All of the adjustments required to be made to fit the individual embossing rolls into their respective bearing supports in a press line, require expert attention by skilled pressmen and precise adjustments that must be completed on the part of these press operators. For this reason and because the entire printing printing press line must remain inactive while the removal of one set of embossing rolls and the fitting of the new set of rolls is accomplished, it is apparent that any speed-up of the change-over procedure is much to be desired.

BRIEF DESCRIPTION OF THIS INVENTION

The embossing roll assembly forming the basis of this invention provides for mounting the rollers in the usual bearings along a press line and in addition a separate harness and bearing assembly means is adapted to be fitted to the opposite ends of each of the pair of matched rolls making up a pair of embossing rolls. The rolls are held in a precisely assembled relationship by the harness means, which rolls and harness assembly can be completed at a work station away from the press line so that a precision assembly of a pair of embossing rolls can be made without interrupting a press line for any longer time than is required to fit the harness assembly into the usual bearings for the embossing rolls that are supported at the embossing station along the press line. Once the usual bearing mounting of the rolls at the embossing station of the precisely constructed harness assembly has been completed, the rolls need only then to be rotatively timed to match the line of printed material flowing to the embossing station. The time consuming precise matching of the peripheries of embossing rolls both rotationally and with respect to the longitudinal axis of the press line is accomplished at a separate work station without necessitating stopping the press. The conventional interfitted gears at the ends of the embossing rolls that are provided to rotate the rolls in unison are suitably marked whereby these gears that are used to precisely position the peripheral surfaces of the embossing rolls, one with respect to the other, are also used as a reference to locate these cooperating die means with respect to the printed design being fed into the embossing rolls.

An important benefit resulting from the use of the additional harness assembly lies in the fact that the unit can be pretested and set for the rotational and longitudinal alignment as well as the proper embossing depth by passing the material to be embossed through the nip, either by hand or by a special drive set-up before sending the assembly to the press station. Once the matched pair of pretested rolls have been precisely fitted together and are held in this precisely assembled relationship with the harness means here shown, the embossing roll and harness assembly can be quickly mounted in its usual bearings at the embossing station of the printing press and coupled to the usual drive means to be easily matched to the line of printed material flowing from the press and the press line is immediately set to roll.

IN THE DRAWINGS

DETAILED DESCRIPTION

Figure 1:
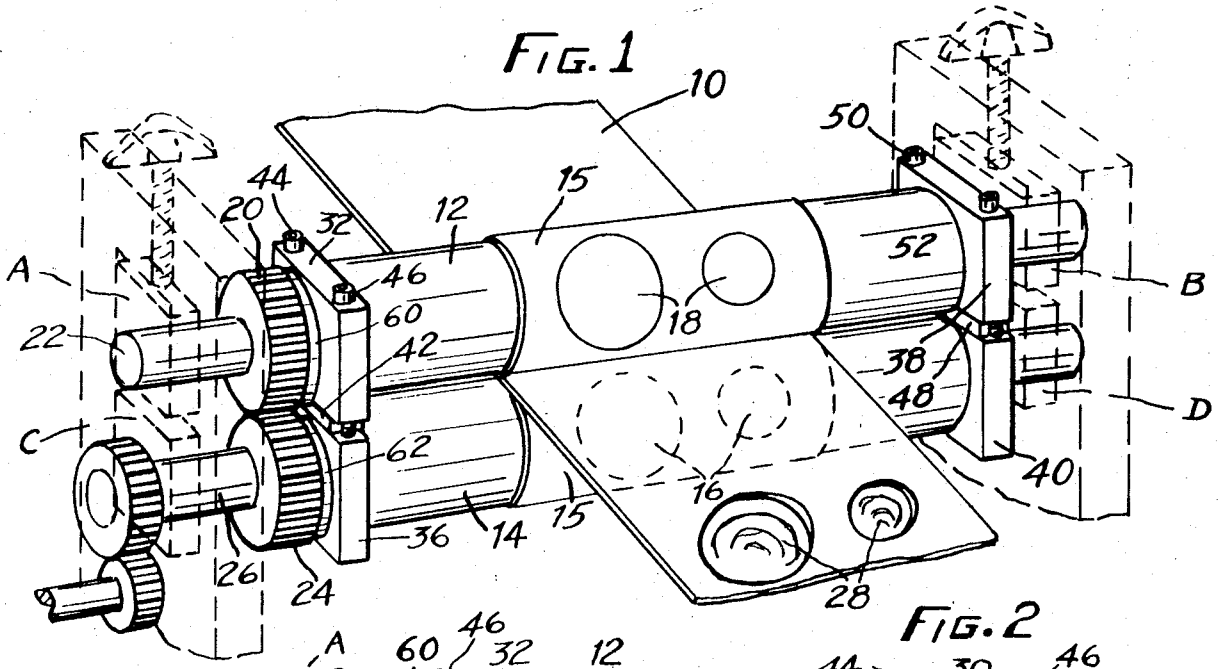
FIG. 1 is perspective showing a pair of the embossing rolls assembled with harness means mounted in a press, wherein the dotted line representation shows a typical embossing station of a printing press.

The dotted line structure shown in FIG. 1 illustrates the usual embossing station positioned, for example, along the press line of a typical label printer machine. After a string of labels 10 have been printed in the press, the strip of labels flow along to the embossing station where the labels are fed into the nip formed at the entrance to embossing rolls 12 and 14. The peripheries of these rollers are etched or adapted to support matched die means 15 to provide, for example, cooperating male protrusions 16 on roller 14 and female depressions 18 on roll 12. As is well known when rolls 12 and 14 are rotated in unison by the conventional drive means, the gear 20 keyed to bearing shaft 22 of the embossing roll 12 that is rotatably supported in the oppositely positioned bearings A and B shown in dotted lines at the embossing station, coacts with gear 24 keyed to bearing shaft 26 of the embossing roll 14 carried in the oppositely disposed dotted line representations of bearings C and D of the embossing station. The support means for bearings A, B, C and D, are, of course, designed to match the diameters of the embossing rolls mounted therein as is well known to maintain the proper spacing between the rolls.

The gears 20 and 24 as is conventional, are suitably marked so that the male and female peripheries of the pair of embossing rollers can be matched to be driven in synchromism with each other and the printed design on the infeeding label strip. When the strip 10 having a successive pattern of labels printed thereon, for example, passes between the rotatably driven embossing rolls, the die elements 16 and 18 coact with the label patterns to produce successive three dimension embossed areas 28 on the strip. Such press structure and the operation of embossing rolls is well known. In the use of a conventional press and embossing means, it is the necessity for stopping the press for the entire time that is required for the precise mounting of the pair of coacting embossing rolls in bearings A, B, C, and D, that produces the costly down time in the press and requires the expenditure of a considerable amount of the time of skilled press operators to complete the proper mounting, matching, and testing of the male and female embossing rollers at the embossing station and the setting of the screws for controlling the positions of the bearings supporting the rollers to produce the proper depth and uniformity of emboss across the web. It is the purpose of this invention to improve the efficiency of the use of the printing press by eliminating the loss of most of this down time.

In accordance with this invention, the matched pair of embossing rolls are assembled and pretested together in suitable harness means at a work station away from the press line. The precision assembly can then be simply moved to the press line and with the easy mounting thereof in bearings A, B, C, and D, and connection to the drive coupled with the matching of the conventional marks on gears 20 and 24 on the integeared embossing rollers with the flow of the printed pattern of the labels on strip 10, the press line is ready to roll with the new set of already tested embossing rolls in place.

The assembly forming the subject of this invention includes harness supporting means positioned at the opposite ends of the pair of embossing rollers. The harness is adapted to not only permit the assembly of the matched pair of rollers to be made at a work station away from the press line, but as will appear more fully below, the harness means provides an additional support means for the embossing rolls that cooperates with the conventional bearing supports provided at the embossing station of the printing press during a press run, that improves the quality of the resulting embossed pattern.

Figure 2:
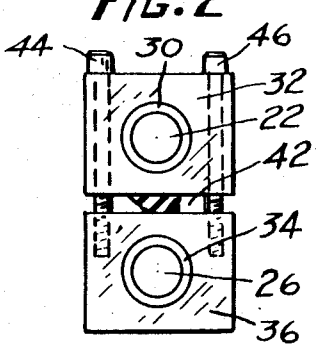
FIG. 2 is a side elevation of one of the harness means.

The harness means is best illustrated in FIG. 2, wherein the bearing shaft 22 of embossing roll 12 is shown to be rotatably carried in bearing 30 in one element 32 of a pair of harness elements. The other embossing roller 14 is mounted integral with shaft 26 that is rotatably carried in bearing 34 of the second harness element 36. The opposite ends of the bearing shafts 22 and 26 of the pair of embossing rolls are similarly rotably supported in bearings carried by a pair of harness elements 38 and 40, see FIG. 1. The pairs of harness elements 32 and 36 and 38 and 40 in this form of the invention are positioned closely adjacent to and at the opposite ends of the pair of embossing rolls.

In some embossing roll set ups, the area of the printed strip to be embossed is not necessarily centrally disposed with respect to the strip, or it may be that the embossed zone is of a narrow design centrally located along the length of the printed pattern. When such a situation is encountered, a narrow lighter weight pair of embossing rolls, integral with elongated bearing shafts can be provided to coact with the strip of printed material along the line of the desired embossed zones only. When the matched pair of embossing rolls have a width less than the space between the press frames, either at the centerline of the press or at one or the other of its sides, the harness sets of this invention are designed to be assembled with the rolls spaced apart a distance to let the printed strip flow through but as close as possible to the immediate ends of the embossing cie areas on the rolls rather than at the ends of the bearing shafts for the roll structures adjacent the press frames.

In either case, the bearing shafts 22 and 26 of the rollers extend past the harness means to be rotably carried in bearings A, B, C, and D, at the opposite sides of the press, and one end of shaft 26 may extend beyond bearing C to support a conventional gear drive means for rotating the embossing rollers in timed relation to the movement of strip 10 between the rollers in the usual manner.

The size of the harness element 32 is selected to be approximately the same size or smaller than the diameter of roller 12 and is spaced away from harness element 36, that is preferably designed to be the same size as or smaller than the diameter of roll 14, by means of a firmly resilient spring or elastomeric material or firm rubber cushion 42 which, cooperates with the rollers to produce a firm smooth running pressure between the rollers and the strip being embossed. The two harness elements 32 and 36 are held in a properly adjusted position by bolts 44 and 46 that draw the two elements of the pair together against the resilience of the cushion 42. The harness elements 38 and 40 at the other end of the rollers are similarly paired, with cap screws or bolts 50 and 52 being provided to adjust their spacing against the resilience of spacer 48 positioned between them. The respective pairs of the harness elements at the opposite ends of rollers 12 and 14 are carefully adjusted to provide a proper spacing between the die surfaces on the peripheries of the rolls to permit the printed material that is being embossed to flow easily between the rolls.

Figure 3:
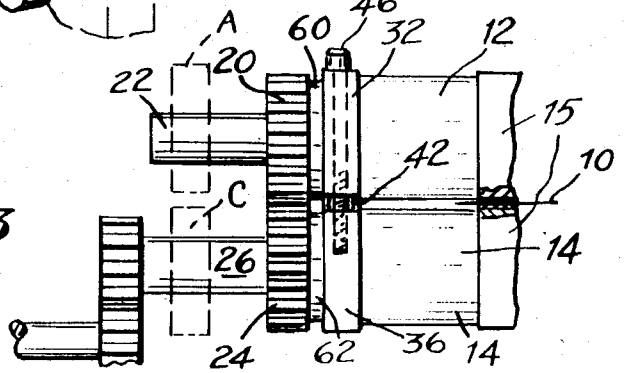
FIG. 3 is a front elevation partly broken away showing the intergeared embossing rolls and one harness means.

The embossing rollers are made to rotate in synchronism by the matching gears 20 and 24 as is conventional. These gears are marked so that the male and female peripheral die means 16 and 18 that are carried on the bearing shafts of the rolls 12 and 14 will be made to rotate together in a properly timed sequence to produce the desired embossed pattern. The embossing rolls 12 and 14 and the harness means 32–36 and 38–40 may be held spaced respectively longitudinally along their bearing shafts 22 and 26 by any suitable means such as, for example, retaining collars 60 and 62 best seen in FIGS. 1 and 3. A similar pair of retaining collars may be provided at the opposite ends of rollers 12 and 14 all of which retaining means maybe adjustably fixed to the bearing shafts 22 and 26 immediately outside of the pairs of harness elements 32–36 and 38–40 to hold the embossing rolls in proper longitudinal alignment with the pattern of the printed material on strip 10 coming from the printing press.

The harness structure described above is designed to provide a fully operational support means for a pair of embossing rollers that is adapted to permit the precision assembly of these rollers in the harness upport at a work station that is separate from the printing press. After the matched pair of male and female embossing rollers has been prepared on their respective shafts 22 and 26, the harness means 32–36 and 38–40 together with their resilient spacers 42 and 48 and their bolts 44–46 and 50–52 may be fitted on shafts 22 and 26 at the opposite ends of the embossing rolls respectively, then the retaining or spacer collars 60 and 62 may be fitted onto the shafts. When the pair of rollers have been adjusted with shafts 22 and 26 to precisely match the longitudinal center line of the strip of printed material that will be fed to the rollers, and all of the retaining collars have been locked in place on shafts 22 and 26, the marked gears 20 and 24 are mounted on and keyed to shafts 22 and 26 and are meshed together in the known manner to cause the male and female embossing die patterns on the respective embossing dies to rotate together. Thus the precise longitudinal and rotational matching of the embossing rollers can be completed relative to the harness support elements and the embossing rollers may be adjusted together against the resilience of spacers 42 and 48 by means of bolts 44–46 and 50–52 prior to assembly with the press, to provide the precise spacing and embossing pressure needed for the strip of printed matter 10 to pass between the dies to be embossed. After the assembly has been completed a strip of printed material can be run through the embossing rolls at the work station to test the harness set up and make any final adjustments that may be needed.

As distinguished from the assembly described above, in some instances it may be desireable to assemble the rolls together with the matched gears 20 and 24 positioned adjacent the ends of the rolls with the harness on the outside of the gears but inside the press line bearings from the embossing station. When, in the case of narrow presses or if longer embossing rolls are being set up between A, B, C, and D, it is sometimes an advantage to have the harness outside of these meshing gears should there be any need to make an adjustment of the harness means during a press run, to control the embossing roll pressure, for example.

After the precise harnessed assembly and testing has been completed at the separate work station, when required, the assembly may be brought to the embossing station along the press line for assembly with the printing press. It is merely necessary to then place bearing shafts 22 and 26 in bearings A, B, C, and D, and turn shaft 26 to the proper rotated position to cause the die means 16 and 18 to match properly with the printed matter coming from the printing press to produce the desired embossed product. Because the tedious, time consuming make ready time loss has been removed from the presside by the precision fitting and assembly of the paired embossing rolls that has been completed at a work station that is separate from the printing press, the working press need be stopped only for a very short period between runs merely to complete the removal of one set of embossing rolls and the fitting a new preassembled unit in place. Once the previously assembled harness unit is brought to the embossing station, shafts 22 and 26 can be quickly fitted into bearings A, B, C, D, and the driving gear which may be either on the inside or outside of the press structure, can be fitted to the drive through shaft 26, for example, and the press may be almost immediately started on a new run.

Another advantage inherent in the use of the harness structure described above resides in the separation of the embossing pressure control from the pressure control applied to the shafts 22 and 26 to hold the driving gears properly in mesh. As shown in FIG. 1 the bearings A–C are held in place with thumb screw E to maintain the proper driving engagement between the gears in the embossing roll drive. Likewise, bearings B–D are properly positioned to maintain shafts 22 and 26 in their parallel relationship by thumb screw F. This is conventional structure that would normally be called upon to also maintain the embossing roll pressure. But as described above, these matched rollers, supported by the harness means, are precisely positioned in spaced relation by means of the spacers 42 and 48 and the adjustment of cap screws 44–46 and 50–52. This separation of pressure controls provides for a more perfect application of the desired embossing pressure against the printed strip 10 being worked upon. The splitting of the several pressure control means separates the pressure of the pressure means required for maintaining the drive of the assemble through the meshing of and holding of the gears in place from the cap screw adjusting screws for the resilient spacer or spacing pad means that precisely controls the embossing pressure.

It is also to be noted that the harness bearings 30 and 34 in elements 32 and 36 and similar bearings in elements 38 and 40 of the harness mounting means, engage shafts 22 and 26 immediately at the opposite ends of each of the embossing rollers. Since they are spaced as closely as possible to the working zones of the embossing rollers, a better control of the deflection forces produced in the rollers is accomplished as the printed strip passes between the rollers to be embossed. As compared with the supporting only the ends of the shafts 22 and 26 in bearings A–B and C–D, the use of the additional harness bearings at the ends of the embossing rolls adjacent the edges of the printed strip that passes between the rollers, more surely contains the pressure forces generated when the embossing rolls are engaged on the printed strip, to produce a more perfectly embossed pattern in the finished product.

The more efficient control of deflection forces by means of the harness mounting described herein suggests that lighter weight embossing rollers may be used with an appropriate control of deflection whereby the harness assembly operation can be completed more easily. This permits the use of lighter weight assembly stands and such other tools as may be needed to hold the embossing rolls while the harness elements and other pieces of the assembly are brought into place and the assembly precisely adjusted and completed as a unit adapted to then be transported to a printing press for mounting at the embossing station.

It should be noted that when embossing rolls of different diameters are selected to be carried in the harness assembly here shown, that the bearings A, B, C, and D, must be suitably selected to match the centerlines about which the shafts 22 and 26 are designed to rotate. Likewise as is well known, the gears 20 and 24 and the driving gear train must be designed in the conventional manner to drive the embossing rolls in a properly timed relationship to the flow of the printed material from the press.

With the structure described above, it is apparent that a precision registration of the mating male and female embossing rolls can be produced in the harness assembly with greater ease at a separate work station and without the skilled workman being pressured with the knowledge that an entire printing line is being held idle while he works. The precision assembly completed under optimum working conditions may then be transported to the embossing station and inserted as a unit in place without the necessity of making any further precision adjustments to fit the embossing rolls in place, so that the printing press can be again placed in operation much more quickly.

While the above describes the preferred form of this invention it is possible that modifications thereof may occur to those skilled in the art that will fall within the scope of the following claims.

What is claimed:

1. A removable and replaceable assembly for supporting a matched pair of embossing rolls for rotation in the embossing station of a printing press comprising:

said rolls;

two pair of harness means, each pair including two blocks, each block supporting a roll bearing therein, threaded fasteners interconnecting said blocks parallel to the plane of said bearings and resilient means between said blocks biassing them away from each other;

a pair of matching gears engaged with each other and keyed to adjacent ends of said rolls for rotating said rolls in synchronism with each other when one or the other of said gears is driven, said gears being positioned axially outwardly of one of said pairs of harness means;

means for holding said bearing elements in each harness pair, in adjustable spaced relation to support said rolls in proper embossing relation to each other; and means for adjusting the longitudinal relation of said rolls with respect to each other;

whereby said assembly may be totally prealigned remote from the press and then placed in the press and coupled to the press drive.

2. An assembly as defined by claim 1 which in operative position lies between the side walls of a printing press downstream of the printing station.

* * * * *